US009372421B2

(12) United States Patent
Malachowski et al.

(10) Patent No.: US 9,372,421 B2
(45) Date of Patent: Jun. 21, 2016

(54) SYSTEM AND METHOD FOR CONVENTIONAL PARTICLE ROUNDING UTILIZING CONTINUOUS EMULSION-AGGREGATION (EA) TECHNOLOGY

(71) Applicant: XEROX CORPORATION, Norwalk, CT (US)

(72) Inventors: Steven M. Malachowski, East Rochester, NY (US); Eric Joseph Young, Webster, NY (US); Linda Jan, Webster, NY (US); Eric David Godshall, Macedon, NY (US); Brian J. Marion, Ontario, NY (US); Chieh-Min Cheng, Rochester, NY (US)

(73) Assignee: XEROX CORPORATION, Norwalk, CT (US)

( * ) Notice: Subject to any disclaimer, the term of this patent is extended or adjusted under 35 U.S.C. 154(b) by 6 days.

(21) Appl. No.: 14/534,058

(22) Filed: Nov. 5, 2014

(65) Prior Publication Data

US 2016/0124331 A1 May 5, 2016

(51) Int. Cl.
*G03G 9/08* (2006.01)

(52) U.S. Cl.
CPC ..... *G03G 9/081* (2013.01); *G03G 9/0804* (2013.01); *G03G 9/0815* (2013.01)

(58) Field of Classification Search
CPC ..... G03G 9/0804; G03G 9/0815
USPC ..... 430/137.15
See application file for complete search history.

(56) References Cited

U.S. PATENT DOCUMENTS

| | | | |
|---|---|---|---|
| 3,590,000 | A | 6/1971 | Palermiti et al. |
| 3,944,493 | A | 3/1976 | Jadwin et al. |
| 4,007,293 | A | 2/1977 | Mincer et al. |
| 4,079,014 | A | 3/1978 | Burness et al. |
| 4,394,430 | A | 7/1983 | Jadwin et al. |
| 4,560,635 | A | 12/1985 | Hoffend et al. |
| 5,959,066 | A | 9/1999 | Charbonneau et al. |
| 6,025,061 | A | 2/2000 | Khanarian et al. |
| 6,063,464 | A | 5/2000 | Charbonneau et al. |
| 6,063,827 | A | 5/2000 | Sacripante et al. |
| 6,107,447 | A | 8/2000 | Kreuder et al. |
| 6,214,507 | B1 | 4/2001 | Sokol et al. |
| 6,359,105 | B1 | 3/2002 | Ianni et al. |

(Continued)

*Primary Examiner* — Mark A Chapman
(74) *Attorney, Agent, or Firm* — Pillsbury Winthrop Shaw Pittman LLP

(57) ABSTRACT

In an exemplary embodiment of the invention, a continuous process for rounding conventional toner particles includes forming a conventional toner particle slurry by mixing a dispersant and/or a liquid with dry toner particles, heating the conventional toner particle slurry to a first temperature beyond its glass transition temperature to form a coalesced toner particle slurry, quenching the coalesced toner particle slurry to a second temperature below the glass transition temperature after a residence time has elapsed, and recovering the quenched particle slurry at an outlet wherein the circularity of the conventional toner particles in the quenched toner particle slurry is from approximately 0.940 to 0.999 and the time frame for the heating, quenching and recovering steps is less than 20 minutes. An apparatus for practicing the novel continuous coalescence of toner particles, includes an inlet passage, a first heat exchanger coupled to the inlet passage, a residence time coil coupled to the first heat exchanger, a cooling device coupled to the residence time coil; and an outlet passage coupled to the cooling device.

20 Claims, 14 Drawing Sheets

AFTER, PROCESS OUTLET, T = 3 MINUTES (x2.00K):

(56) References Cited

U.S. PATENT DOCUMENTS

| | | | | |
|---|---|---|---|---|
| 6,593,049 | B1 | 7/2003 | Veregin et al. | |
| 6,756,176 | B2 | 6/2004 | Stegamat et al. | |
| 6,830,860 | B2 | 12/2004 | Sacripante et al. | |
| 7,452,646 | B2 | 11/2008 | Hu et al. | |
| 2007/0015075 | A1 | 1/2007 | Vijayendran et al. | |
| 2008/0145775 | A1 | 6/2008 | Vijayendran et al. | |
| 2015/0111151 | A1* | 4/2015 | Lawton | G03G 9/0804 430/137.14 |
| 2015/0160574 | A1* | 6/2015 | Morales-Tirado | G03G 9/0804 430/108.8 |

* cited by examiner

Toner (Parent Particle) Circularity Results

BEFORE "CONTINUOUS COALESCENCE" PROCESS:

| Selection (Diam/Shape) | Result | | | | | |
|---|---|---|---|---|---|---|
| | CE Diameter | | Circularity | | | |
| Particle Diameter | Mean: | 7.430 | Mean: | 0.942 | Density: | 2655 |
| 0.500 <= CE Diameter < 200.0 | SD: | 2.191 | SD: | 0.041 | Large(%): | 0.00 |
| Particle Shape | CV: | 29.49 | CV: | 4.36 | Middle(%): | 100.00 |
| 0.200 <= Circularity <= 1.000 | Mode: | 6.123 | Mode: | 0.955 | Small(%): | 0.00 |
| | Lower%: | 5.178 | Lower%: | 0.903 | Selected(%): | 100.0 |
| | 50%: | 7.368 | 50%: | 0.949 | Analyzed(#) | 1084 |
| | Upper%: | 10.254 | Upper%: | 0.976 | Selected(#) | 1084 |

Particle Samples

AFTER "CONTINUOUS COALESCENCE" ROUNDING PROCESS = 3 MINUTES:
(at a process flow rate of 240 mL/minute)

| Selection (Diam/Shape) | Result | | | | | |
|---|---|---|---|---|---|---|
| | CE Diameter | | Circularity | | | |
| Particle Diameter | Mean: | 7.682 | Mean: | 0.972 | Density: | 581 |
| 0.500 <= CE Diameter < 200.0 | SD: | 4.366 | SD: | 0.052 | Large(%): | 0.00 |
| Particle Shape | CV: | 56.84 | CV: | 5.33 | Middle(%): | 100.00 |
| 0.200 <= Circularity <= 1.000 | Mode: | 8.197 | Mode: | 0.995 | Small(%): | 0.00 |
| | Lower%: | 1.308 | Lower%: | 0.924 | Selected(%): | 100.00 |
| | 50%: | 7.022 | 50%: | 0.991 | Analyzed(#) | 237 |
| | Upper%: | 14.087 | Upper%: | 1.000 | Selected(#) | 237 |

Particle Samples

AFTER "CONTINUOUS COALESCENCE" ROUNDING PROCESS = 3 MINUTES:
(at a process flow rate of 360 mL/minute)

| Selection (Diam/Shape) | Result | | | | | |
|---|---|---|---|---|---|---|
| | CE Diameter | | Circularity | | | |
| Particle Diameter | Mean: | 6.330 | Mean: | 0.981 | Density: | 585 |
| 0.500 <= CE Diameter < 200.0 | SD: | 3.785 | SD: | 0.046 | Large(%): | 0.00 |
| Particle Shape | CV: | 59.80 | CV: | 4.73 | Middle(%): | 100.00 |
| 0.200 <= Circularity <= 1.000 | Mode: | 4.824 | Mode: | 0.995 | Small(%): | 0.00 |
| | Lower%: | 1.310 | Lower%: | 0.957 | Selected(%): | 100.00 |
| | 50%: | 5.759 | 50%: | 0.993 | Analyzed(#) | 242 |
| | Upper%: | 11.584 | Upper%: | 1.000 | Selected(#) | 242 |

Particle Samples

Light Microscope Pictures (Magnification Lens = 50X)
BEFORE, PROCESS INLET:

AFTER, PROCESS OUTLET, T = 3 MINUTES:

Scanning Electron Microscope (SEM) Images
BEFORE, PROCESS INLET (x3.00K):

AFTER, PROCESS OUTLET, T = 3 MINUTES (x2.00K):

BEFORE, PROCESS INLET (x6.00K):

AFTER, PROCESS OUTLET, T = 3 MINUTES (x6.00K):

BEFORE, PROCESS INLET (x10.00K):

AFTER, PROCESS OUTLET, T = 3 MINUTES (x10.00K):

BEFORE, PROCESS INLET (x30.00K):

AFTER, PROCESS OUTLET, T = 3 MINUTES (x30.00K):

Transmission Electron Microscope (TEM) Images
BEFORE, PROCESS INLET (Direct Magnification of 700X):

AFTER, PROCESS OUTLET,
T = 3 MINUTES (Direct Magnification of 700X):

BEFORE, PROCESS INLET (Direct Magnification of 3500X):

AFTER, PROCESS OUTLET,
T=3 MINUTES (Direct Magnification of 3500X):

BEFORE, PROCESS INLET (Direct Magnification of 12,000X):

AFTER, PROCESS OUTLET,
T=3 MINUTES (Direct Magnification of 12,000X):

SYSTEM AND METHOD FOR CONVENTIONAL PARTICLE ROUNDING UTILIZING CONTINUOUS EMULSION-AGGREGATION (EA) TECHNOLOGY

TECHNICAL FIELD

The present disclosure relates generally to quickly and effectively round toner parent particles, after they have been extruded, ground and classified, by using a high-throughput and low-resistance-time type heat exchanger system.

BACKGROUND

Toner compositions are used with electrostatographic, electrophotographic or xerographic print or copy devices. In such devices, an imaging member or plate comprising a photoconductive insulating layer on a conductive layer is imaged by first uniformly electrostatically charging the surface of the photoconductive insulating layer. The plate is then exposed to a pattern of activating electromagnetic radiation, for example, light, which selectively dissipates the charge in the illuminated areas of the photoconductive insulating layer while leaving behind an electrostatic latent image in the non-illuminated areas. The electrostatic latent image may then be developed to form a visible image by depositing firmly divided electroscopic toner particles, for example from a developer composition, on the surface of the photoconductive insulating layer. The resulting visible toner image can be transferred to a suitable receiving substrate such as paper.

Xerox uses two manufacturing strategies in production of its toner parent particle products, a chemical toner process (known as EA or "Emulsion-Aggregation" technology) as well as a conventional production process. Rounded toner particles are produced primarily through the EA chemical toner process.

In the EA chemical toner process, raw materials are dispersed in a solution using water, surfactant, and high-intensity homogenization equipment. This EA chemical toner process is water-intensive and time-consuming. A chemical aggregation process is used to grow the toner particles to a targeted sized. These toner particles are then rounded in a batch process known as coalescence. In the coalescence process, a batch of chemical slurry is mixed and heated in a vessel or reactor to a temperature that is greater than the glass transition temperature (Tg) of the latex resin. The goal of this process is obtain a round particle. A round particle has a shape factor of between 0.97 and 1.0, which varies by product.

As for the conventional toner particle production, this conventional toner technology produces irregularly-shaped toner particles via a process of extrusion and physical grinding. In this process, extruder material is physically ground and classified to achieve the desired particle size and distribution. Other toner particle producers have explored methods to surface-modify conventionally produced toner particles via special grinding and blending processes. Xerox has investigated the feasibility of using equipment, e.g., Hosokawa Cyclomix, to round such conventional particles. In this process using the Hosokawa Cyclomix, the equipment employs additives, heat, mechanical shearing, and agitation to attempt to make round particles. This is very time intensive, not efficient and it requires a lot of energy. The process of modifying conventionally produced toner particles to make round particles takes, for example, multiple hours and normally more than three hours. In addition, the process of modifying conventionally produced toner particles to make round particles may damage an internal structure of the conventionally produced toner particles.

It would be desirable to provide a conventional toner particle process that allows for the production of round particles that is more efficient, takes much less time, results in a consistent toner product, does not impact the internal structure of the conventional toner particle, and enables reduced energy consumption.

Similarly, xerographic toners for Magnetic Ink Character Recognition (MICR) require a certain magnetic remanence and coercivity to allow check scanners (or MICR readers) to read the magnetically encoded text. These toners are normally achieved by doping magnetite (e.g., iron oxide) in to the toner particles. The magnetite is typically acicular and has relatively large dimensions ranging from 0.1 microns to 0.6 microns. A large loading (30 to 50 percent) of these particles is required to achieve the required magnetite's low retentivity. Xerox currently produces MICR particles through the conventional "Banbury" process or utilizing extrusion technology. Then, energy intensive processes like pulverizing and classification are employed to break the particles down to a needed size. However, these energy intensive processes lead to high costs. For example, the current magnetic toners are made normally through a conventional route, where the magnetite is blended with resin and wax and either extruded or made via the Banbury method, which involves large slabs of the mixture being broken down mechanically.

There has been a desired to make a magnetic EA toner for a number of years. EA MICR toners are desired because the process is water based and more environmentally friendly than the conventional process with less excessive heating. All of this leads to lower toner costs.

One of the main EA properties that is desired in an MICR toner particle is to create MICR particles with high circularities. This has been proven difficult to achieve via the conventional toner process. The reason is because the large particle size of the acicular magnetite (i.e., 0.1 to 0.6 micron) makes it very difficult for incorporation into the latex (which has a particle size of around 0.2 microns). This leads to challenges into incorporating magnetite into EA particles and successfully undergoing aggregation and then coalescence. The larger magnetite particle size can provide better tribo and image density. The higher magnetite readings also help with readability of the MICR toner. However, the large magnetite size, loading requirement, and high density makes these type of particles difficult to disperse and stabilize. Thus, incorporation into EA toners is difficult.

Further, magnetite loading and circularity are normally inversely proportional. The high magnetite leverl may lower the amount of latex available for particle formation, and getting enough resin to the surface to spheroidize the particles is one of the primary concerns. Achieving the spheroid shape improves machine performance for EA toners. Another issue is that the required magnetite loadings can cause unacceptable particle morphologies and rough surface structures, which negatively impact toner additive blending.

SUMMARY OF THE INVENTION

The present disclosure relates to a novel method to quickly and effectively round toner parent particles. This method is performed after they have been extruded, ground and classified as part of the Xerox's conventional toner process. The process utilizes a high-throughput and low-residence-time type heat exchanger system. The new process is a continuous process that makes conventionally-produced particles more EA-like, by quickly spheroidizing the particles and increasing uniformity. This ultimately improves toner characteristics such as the flow and transfer efficiency in the machine and it's sub-assemblies for existing toners or to use in new products.

In an exemplary embodiment of the invention, a continuous process for rounding conventional toner particles includes forming a conventional toner particle slurry by mixing a dispersant and/or a liquid with dry toner particles, heating the conventional toner particle slurry to a first temperature beyond its glass transition temperature to form a coalesced toner particle slurry, quenching the coalesced toner particle slurry to a second temperature below the glass transition temperature after a residence time has elapsed, and recovering the quenched particle slurry at an outlet wherein the circularity of the conventional toner particles in the quenched toner particle slurry is from approximately 0.940 to 0.999, and the time frame for the heating, quenching and recovering steps is less than 20 minutes. In addition, the continuous process of the present invention minimally disturbs an internal structure of the conventional toner particles. The continuous process of the present invention may also be applied to MICR toner particles.

In an embodiment of the invention, the time frame for the heating, quenching and recovering steps is less than 20 minutes. In an embodiment of the invention, the residence time is from about 10 seconds to 15 minutes. In an embodiment of the invention, the heat energy captured prior to quenching the coalesced toner slurry in the second heat exchanger is transferred to the toner particle slurry prior to coalescence in later flows of the toner particle slurry.

An apparatus for practicing the novel continuous coalescence of toner particles, includes an inlet passage, a first heat exchanger coupled to the inlet passage, a residence time coil coupled to the first heat exchanger, a cooling device coupled to the residence time coil; and an outlet passage coupled to the cooling device, wherein a toner particle slurry is transferred from the inlet passage to the first heat exchanger and to the residence time coil to become a coalesced toner particle slurry and the coalesced toner particle slurry is transferred to the cooling device to become the quenched toner particle slurry and then transferred to the outlet passage, wherein the circularity of the conventional toner particles in the quenched toner particle slurry is from approximately 0.940 to 0.999 and the time frame for the heating, quenching and recovering steps is less than 20 minutes. In addition, the continuous process of the present invention minimally disturbs the internal structure of the conventional toner particles.

BRIEF DESCRIPTION OF THE DRAWINGS

The foregoing aspects and other features of an inkjet printing apparatus, which enables visually detection of defective inkjets in a printhead are explained in the following description, taken in connection with the accompanying drawings.

DETAILED DESCRIPTION

Figure 1:
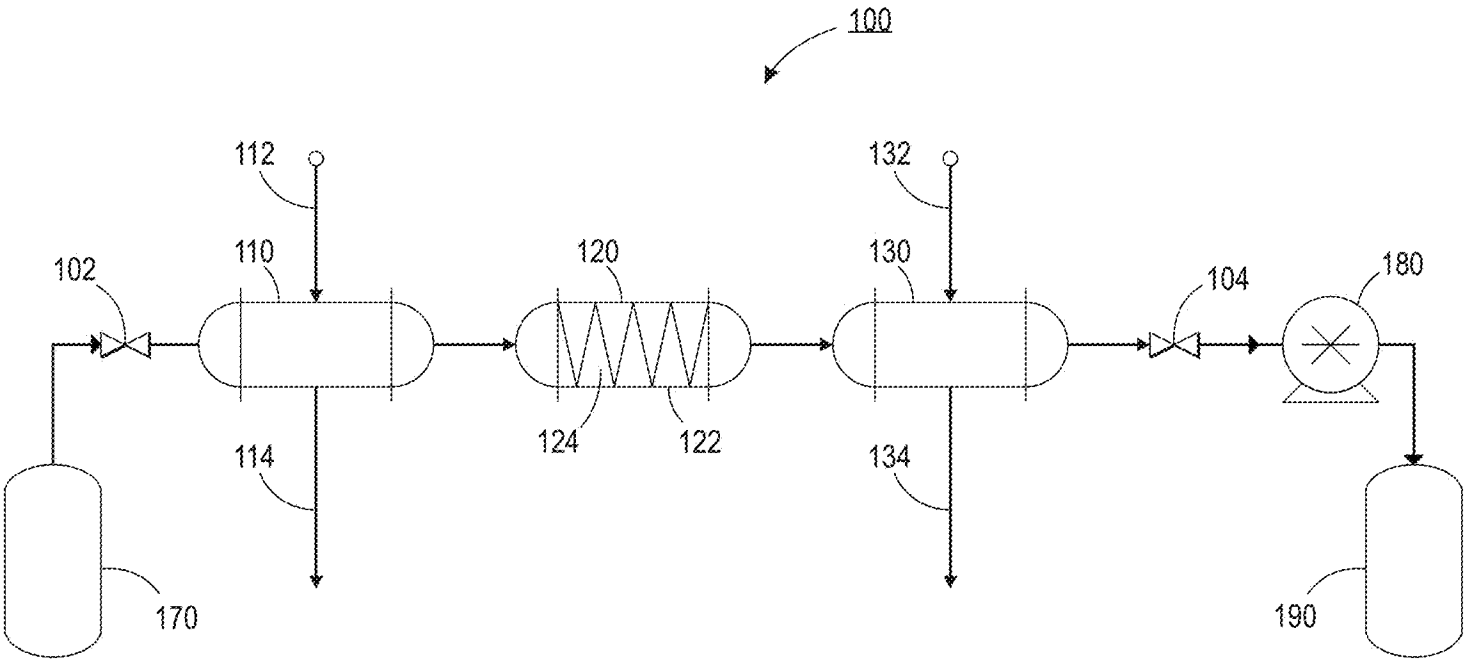
FIG. 1 is a schematic diagram illustrating a first exemplary apparatus suitable for practicing the process of the present disclosure.

For a general understanding of the environment for the system and method disclosed herein and the details for the system and method, reference is made to the drawings. In the drawings, like reference numerals have been used throughout to designate like elements. As used herein, the words "printer" and "imaging apparatus", which may be used interchangeably, encompasses any apparatus that performs a print outputting function for any purpose, such as a digital copier, bookmaking machine, facsimile machine, a multi-function machine, etc. Furthermore, a printer is an apparatus that forms images with marking material on media and fixes and/or cures the images before the media exits the printer for collection or further printing by a subsequent printer.

Toner Preparation—

In embodiments, toners of the present disclosure may be formed by melt mixing utilizing methods and apparatus within the purview of those skilled in the art. For example, melt mixing of the toner ingredients can be accomplished by physically mixing or blending the particles of the above components and then melt mixing, for example, in an extruder or a Banbury/two roll mill apparatus. Suitable temperatures may be applied to the extruder or similar apparatus, for example from about 65° C. to about 200° C., in embodiments from about 80° C. to about 120° C.

The components of the toner, including the resin(s), wax, if any, colorant, and other additives, may be combined so that the toner extrudate has the desired composition of colorants and additives. The toner extrudate may then, in embodiments, be divided into a pellet or rough crushed form, sometimes referred to herein as "pelletizing," utilizing methods within the purview of those skilled in the art, for example, by pelletizers, fitzmilling, pinmilling, grinders, classifiers, additive blenders, screeners, combinations thereof, and the like. As used herein, "pelletizing" may include any process within the purview of those skilled in the art which may be utilized to form the toner extrudate into pellets, a rough crushed form, or coarse particles, and "pellets" include toner extrudate divided into pellet form, rough crushed form, coarse particles, or any other similar form.

Resins—

Any suitable resin may be utilized in forming a toner of the present disclosure. Such resins, in turn, may be made of any suitable monomer. Any monomer employed may be selected depending upon the particular polymer to be utilized.

In embodiments, the resin may be a polymer resin including, for example, resins based on styrene acrylates, styrene butadienes, styrene methacrylates, and more specifically, poly(styrene-alkyl acrylate), poly(styrene-1,3-diene), poly-styrene-alkyl methacrylate), poly(styrene-alkyl acrylate-acrylic acid), poly(styrene-1,3-diene-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly (styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymers may be block, random, or alternating copolymers.

In other embodiments, the resins utilized to form toners of the present disclosure may be polyester resins. Such polyester resins may be an amorphous resin, a crystalline resin, and/or a combination thereof. In further embodiments, the polymer utilized to form the resin may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly (propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

In embodiments, an unsaturated amorphous polyester resin may be utilized as a resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

In embodiments, a suitable polyester resin may be an amorphous polyester such as a poly(propoxylated bisphenol A co-fumarate) resin having the following formula (I): ##STR00001## wherein m may be from about 5 to about 1000. Examples of such resins and processes for their production include those disclosed in U.S. Pat. No. 6,063,827, the disclosure of which is hereby incorporated by reference in its entirety.

In some embodiments, the amorphous resin may be cross-linked. An example is described in U.S. Pat. No. 6,359,105, the disclosure of which is hereby incorporated by reference in its entirety. For example, crosslinking may be achieved by combining an amorphous resin with a crosslinker, sometimes referred to herein, in embodiments, as an initiator. Examples of suitable crosslinkers include, but are not limited to, for example, free radical or thermal initiators such as organic peroxides and azo compounds.

In embodiments, an amorphous resin utilized to form a toner of the present disclosure may be at least one bio-based amorphous polyester resin, optionally in combination with another amorphous resin as noted above. As used herein, a bio-based resin is a resin or resin formulation derived from a biological source such as vegetable oil instead of petrochemicals. As renewable polymers with low environmental impact, their principal advantages are that they reduce reliance on finite resources of petrochemicals; they sequester carbon from the atmosphere. A bio-resin includes, in embodiments, for example, a resin wherein at least a portion of the resin is derived from a natural biological material, such as animal, plant, combinations thereof, and the like. In embodiments, at least a portion of the resin may be derived from materials such as natural triglyceride vegetable oils (e.g. rapeseed oil, soybean oil, sunflower oil) or phenolic plant oils such as cashew nut shell liquid (CNSL), combinations thereof, and the like. Suitable bio-based amorphous resins include polyesters, polyamides, polyimides, polyisobutyrates, and polyolefins, combinations thereof, and the like. In some embodiments, the bio-based resins are also biodegradable.

In embodiments, an amorphous resin utilized to form a toner of the present disclosure may be at least one bio-based amorphous polyester resin, optionally in combination with another amorphous resin as noted above. As used herein, a bio-based resin is a resin or resin formulation derived from a biological source such as vegetable oil instead of petrochemicals. As renewable polymers with low environmental impact, their principal advantages are that they reduce reliance on finite resources of petrochemicals; they sequester carbon from the atmosphere. A bio-resin includes, in embodiments, for example, a resin wherein at least a portion of the resin is derived from a natural biological material, such as animal, plant, combinations thereof, and the like. In embodiments, at least a portion of the resin may be derived from materials such as natural triglyceride vegetable oils (e.g. rapeseed oil, soybean oil, sunflower oil) or phenolic plant oils such as cashew nut shell liquid (CNSL), combinations thereof, and the like. Suitable bio-based amorphous resins include polyesters, polyamides, polyimides, polyisobutyrates, and polyolefins, combinations thereof, and the like. In some embodiments, the bio-based resins are also biodegradable.

Examples of amorphous bio-based polymeric resins which may be utilized include polyesters derived from monomers including a fatty dimer acid, fatty dimer diacid or fatty dimer diol of soya oil, D-isosorbide, and/or amino acids such as L-tyrosine and glutamic acid as described in U.S. Pat. Nos. 5,959,066, 6,025,061, 6,063,464, and 6,107,447, and U.S. Patent Application Publication Nos. 2008/0145775 and 2007/0015075, the disclosures of each of which are hereby incorporated by reference in their entirety. Combinations of any of the foregoing may be utilized, in embodiments. Suitable amorphous bio-based resins include those commercially available from Advanced Image Resources (AIR), under the trade name BIOREZ™ 13062 and BIOREZ™15062. In embodiments, a suitable amorphous bio-based polymeric resin which may be utilized may include a dimer acid of soya oil, isosorbide (which may be obtained from corn starch), with the remainder of the amorphous bio-based polymeric resin being dimethyl terephthalate (DMT). Another suitable bio-based polymeric resin may include about 43.8% by weight D-isosorbide, about 42.7% by weight 1,4-cyclohexane dicarboxylic acid, and about 13.4% by weight of a dimer acid of soya oil.

In embodiments, a suitable amorphous bio-based resin may have a glass transition temperature of from about 45 C to about 70 C in embodiments from about 50 C to about 65 C a weight average molecular weight (Mw) of from about 2,000 to about 200,000, in embodiments of from about 5,000 to about 100,000, a number average molecular weight (Mn) as measured by gel permeation chromatography (GPC) of from about 1,000 to about 10,000, in embodiments from about 2,000 to about 8,000, a molecular weight distribution (Mw/Mn) of from about 2 to about 20, in embodiments from about 3 to about 15, and a viscosity at about 130 C of from about 10 Pa*S to about 100000 Pa*S, in embodiments from about 50 Pa*S to about 10000 Pa*S.

The bio-based polymeric resin may have an acid value of from about 7 mg KOH/g to about 50 mg KOH/g, in embodiments from about 9 mg KOH/g to about 48 mg KOH/g, in embodiments about 9.4 mg KOH/g.

Where utilized, the amorphous bio-based resin may be present, for example, in amounts of from about 1 to about 95 percent by weight of the components used to form the toner particles, in embodiments from about 5 to about 50 percent by weight of the components used to form the toner particles. In embodiments, the amorphous bio-based polyester resin may have a particle size of from about 50 nm to about 250 nm in diameter, in embodiments from about 75 nm to 225 nm in diameter.

In embodiments, suitable latex resin particles may include one or more amorphous bio-based resins, such as a BIOREZ™ resin described above, optionally in combination with one or more of the amorphous resins described above, optionally in combination with a crystalline resin as described below.

As noted above, the amorphous resin may be combined with a crystalline resin. The crystalline resin may be, for example, a polyester, a polyamide, a polyimide, a polyolefin such as a polyethylene, a polypropylene, a polybutylene or an ethylene-propylene copolymer, a polyisobutyrate, an ethylene-vinyl acetate copolymer, combinations thereof, and the like. In embodiments, the crystalline resin may be sulfonated.

The crystalline resin may be prepared by a polycondensation process of reacting an organic diol and an organic diacid in the presence of a polycondensation catalyst.

Examples of organic diols include aliphatic diols with from about 2 to about 8 carbon atoms, such as 1,2-ethanediol, 1,3-propanediol, 1,4-butanediol, 1,5-pentanediol, 1,6-hexanediol, 1,7-heptanediol, 1,8-octanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixtures thereof, and the like. The aliphatic diol may be present in an amount of from about 45 to about 50 mole percent of the resin, in embodiments from about 47 to about 49 mole percent of the resin, and the alkali sulfo-aliphatic diol can be present in an amount of from about 1 to about 10 mole percent of the resin, in embodiments from about 2 to about 8 mole percent of the resin.

Examples of organic diacids or diesters suitable for the preparation of the crystalline resins include oxalic acid, succinic acid, glutaric acid, adipic acid, suberic acid, azelaic acid, phthalic acid, isophthalic acid, terephthalic acid, cyclohexane dicarboxylic acid, malonic acid and mesaconic acid; diesters or anhydrides thereof; and alkali sulfo-organic diacids such as the sodium, lithium or potassium salt of dimethyl- 5-sulfo-isophthalate, dialkyl-5-sulfo-isophthalate-4-sulfo-1, 8-naphthalic anhydride, 4-sulfo-phthalic acid, dimethyl-4-sulfo-phthalate, dialkyl-4-sulfo-phthalate, 4-sulfophenyl-3, 5-dicarbomethoxybenzene, 6-sulfo-2-naphthyl-3,5-d icarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or combinations thereof. The organic diacid may be present in an amount of, for example, from about 40 to about 50 mole percent of the resin, in embodiments from about 42 to about 48 mole percent of the resin, and the alkali sulfo-aliphatic diacid can be present in an amount of from about 1 to about 10 mole percent of the resin, in embodiments from about 2 to about 8 mole percent of the resin.

In embodiments, the crystalline polyester material may be derived from a monomer system including an alcohol such as 1,4-butanediol, 1,6-hexanediol, and combinations thereof, with a dicarboxylic acid such as fumaric acid, succinic acid, oxalic acid, adipic acid, and combinations thereof. For example, in embodiments the crystalline polyester may be derived from 1,4-butanediol, adipic acid, and fumaric acid.

In embodiments, a stoichiometric equimolar ratio of organic diol and organic diacid may be utilized. However, in some instances, wherein the boiling point of the organic diol is from about 180.degree. C. to about 230.degree. C., an excess amount of diol can be utilized and removed during the polycondensation process.

Suitable polycondensation catalysts for production of either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or combinations thereof. Catalysts may be utilized in amounts of, for example, from about 0.01 mole percent to about 5 mole percent based on the starting diacid or diester used to generate the polyester resin, in embodiments from about 0.5 to about 4 mole percent of the resin based on the starting diacid or diester used to generate the polyester resin.

The amount of catalyst utilized may vary, and can be selected in an amount, for example, of from about 0.01 to about 1 mole percent of the resin. Additionally, in place of an organic diacid, an organic diester can also be selected, with an alcohol byproduct generated during the process.

Suitable crystalline resins include, in embodiments, poly (ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof.

In embodiments, the crystalline resin may be a short chain length polyester, based upon monomers having a carbon chain of less than about 8 carbons, in embodiments from about 2 carbons to about 8 carbons, in embodiments from about 4 carbons to about 6 carbons. Such resins include, for example, CPES-A3C, a proprietary blend of 1,4-butanediol, fumaric acid, and adipic acid, commercially available from Kao Corporation (Japan).

The crystalline resin may be present, for example, in an amount of from about 5 to about 50 percent by weight of the toner components, in embodiments from about 10 to about 35 percent by weight of the toner components. The crystalline resin can possess various melting points of, for example, from about 70° C. to about 150° C., in embodiments from about 80° C. to about 140° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 1 to about 6, in embodiments from about 2 to about 4.

One, two, or more resins may be used. In embodiments, where two or more resins are used, the resins may be in any suitable ratio (e.g., weight ratio) such as for instance of from about 1% (first resin)/99% (second resin) to about 99% (first resin)/1% (second resin), in embodiments from about 4% (first resin)/96% (second resin) to about 96% (first resin)/4% (second resin). Where the resin includes an amorphous resin, a crystalline resin, and a bio-based amorphous resin, the weight ratio of the three resins may be from about 97% (amorphous resin): 2% (crystalline resin): 1% (bio-based amorphous resin), to about 92% (amorphous resin): 4% (crystalline resin): 4% (bio-based amorphous resin).

In embodiments, the resin may be formed by condensation polymerization methods. In other embodiments, the resin may be formed by emulsion polymerization methods.

Colorants—

As the colorant to be added, various known suitable colorants, such as dyes, pigments, mixtures of dyes, mixtures of pigments, mixtures of dyes and pigments, and the like, may be included in the toner.

As examples of suitable colorants, mention may be made of carbon black like REGAL 330®; magnetites, such as Mobay magnetites MO8029™ MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™ Northern Pigments magnetites, NP604™, NP608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP604™, NP608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™., D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991 K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871 K (BASF), Paliogen Red 3340 (BASF), Lithol Fast Scarlet L4300 (BASF), combinations of the foregoing, and the like.

Wax—

Optionally, a wax may also be combined with the resin and optional colorant in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 200 to about 20,000, in embodiments from about 400 to about 5,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Additives—

In embodiments of the invention, the toner particles may also contain other optional additives, as desired or required. For example, the toner may include any known charge additives in amounts of from about 0.1 to about 10 weight percent, and in embodiments of from about 0.5 to about 7 weight percent of the toner. Examples of such charge additives include alkyl pyridinium halides, bisulfates, the charge control additives of U.S. Pat. Nos. 3,944,493, 4,007,293, 4,079,014, 4,394,430 and 4,560,635, the disclosures of each of which are hereby incorporated by reference in their entirety, negative charge enhancing additives like aluminum complexes, and the like. In addition, there can be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL® metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner. Suitable additives include those disclosed in U.S. Pat. Nos. 3,590,000, 6,214,507, and 7,452,646 the disclosures of each of which are hereby incorporated by reference in their entirety.

Toner Particles—

The resulting toner particles after toner preparation described above may possess the following characteristics: 1) an average volume particle diameter of from about 5 microns to about 15 microns, in embodiments from about 5.5 microns to about 12 microns; 2) Number Average Geometric Size Distribution (GSDn) and/or Volume Average Geometric Size Distribution (GSDv) of from about 1.0 to about 1.7, in embodiments from about 1.1 to about 1.6; 3) a glass transition temperature of from about 30° C. to about 65° C., in embodiments from about 35° C. to about 51° C.

The characteristics of the toner particles may be determined by any suitable technique and apparatus. Volume average particle diameter ($D_{50v}$), GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

In embodiments of the invention, the invention may utilize toner particles that were created using the processes described above. For example, the invention may utilize a toner (Genctc410-4323) which is a cyan iGen parent particle that was extruded, ground, and classified to particle size specifications. In accordance with the present disclosure, after the toner particles have been subjected to grinding, they are then subjected to the continuous coalesence invention process described below to obtain particles with the desired sphericity.

The invention may also be utilized on toner particles such as MICR toner particles (e.g., Nuvera MICR particles). After the MICR toner particles have extruded, ground and classified, they are subjected to the continuous coalescence process of the invention after being wetted. This results in a smoother surface encapsulating and allowing the full incorporation of higher concentrations of magnetite.

Wetting Toner Particles—

In an embodiment of the invention, the dry toner particles may be wetted by a liquid to form a toner particle slurry. For example, the liquid may be a distilled water, a sodium hydroxide solution, etc. The dry toner particles may be placed in a suitable reactor, such as a mixing vessel. A mixing vessel within the purview of the prior art may be utilized. The liquid and the dry toner particles may be mixed in the mixing vessel for a specified time period. The result of the mixing is the toner particle slurry. The mixing may have been performed at a high or fast agitator speed. For example, the toner particle may be combined with a first amount of liquid.

In one experiment, the liquid consisted of 3700 grams of sodium hydroxide solution (with a pH of 9) and with 100 grams of a 10% aqueous Calfax solution. The end result of this liquid is four liters of dispersion which is by weight 5% iGen toner particle and 0.25% Calfax. The toner particle was mixed in a laboratory mixer. In embodiments of the invention, additional liquid was added in order to increase pH for better performance. For example, in an experiment 40 additional grams of NaOH was added which increased the pH. The toner particle slurry exhibited no coarse materials (i.e., greater than 20 microns). In an embodiment of the invention, the mixing described above was performed for two days.

Continuous Coalescence Process—

FIG. 1 is a schematic diagram illustrating the various components of an apparatus 100 that can be used to practice the continuous coalescence processed of the present disclosure. FIG. 1 is a schematic diagram illustrating a first exemplary apparatus suitable for practicing the process of the present disclosure. The apparatus includes a first heat exchanger for heating the slurry, a residence time coil, and a second heat exchanger for quenching the slurry. As illustrated in FIG. 1, the apparatus includes an inlet 102, an outlet 104, a first heat exchanger 110, a residence time coil 120, and a second heat exchanger 130. The heat exchangers may have a primary or first side and a second side through which fluids may flow. Each side may have an inlet and an outlet. The heat exchangers may be standard shell-tube heat exchangers, spiral heat exchangers, plate heat exchangers, or other heat exchanger apparatus. In embodiments of the invention, the apparatus 100 may also include a holding tank 170, a pump 180 and a receiving tank 190.

The toner particle slurry may be provided from a holding tank 170 into the first heat exchanger 110. Alternatively, a batch aggregation process may pass the toner particle slurry directly into the first heat exchanger 110. Prior to the run, the toner particle slurry may be heated to a temperature in the range from about 35° C. to 60° C. This may be referred to as preheating the toner particle slurry. The toner particle slurry prior to the run may have a pH in the range of 2.5 to 6.5.

In embodiments of the invention, the toner particle slurry is drawn from the holding tank 170 and passes through the inlet 102 into the first heat exchanger 110. In the first heat exchanger, the toner particle slurry is further heated to a first temperature greater than the glass transition temperature of the toner particle. In some embodiments, the first temperature is from 70° C. to about 110° C., or more restrictively, from 80° C. to approximately 96° C. Line 112 represents the hot secondary fluid used to heat the toner particle slurry and line 114 represents the cooled secondary fluid exiting the first heat exchanger 110. In embodiments of the invention, the hot secondary fluid may have a temperature ranging from 90° C. to 120° C.

In embodiments of the invention, the flow rate that the toner particle slurry is pumped in at a rate of 240 ml/minute. In an alternative embodiment, the toner particle slurry flow rate is 360 ml/minute. In the present invention, the toner particle slurry flow rate runs between 200 to 600 ml/minute.

In an alternative embodiment of the invention, the final toner particle slurry may be preheated to a temperature greater than the glass transition temperature of the resin in a batch process in an aggregation vessel before introducing the toner slurry to the heat exchanger system (e.g., the first heat exchanger 110) to continuously coalesce the particles. In other words, a separate vessel is used (e.g., the aggregation vessel) to preheat the toner slurry before it is drawn into the first heat exchanger 110. Pre-heating the slurry in the aggregation vessel prior to adding the slurry to the heat exchanger system eliminates the need for an additional piece of reaction equipment to carry out the preheating step. It also eliminates the need for a introducing the hot secondary fluid into the first heat exchanger 110.

Coalescence occurs at the elevated temperature. The heated toner slurry has a pH range of 2.5 to 7.0. The now heated toner particle slurry, having this first temperature, subsequently may require a local coalescence residence time, in addition to the time spent in first heat exchanger and conveying pipe (between the first heat exchanger 110 and the residence time coil 120), for the aggregated particles to condense and coalesce. The local coalescence time may be from about 10 seconds to 10 minutes, including from about 10 seconds to about 10 minutes, or from about 15 seconds to 5 minutes or from about 30 seconds to 2 minutes. This time is a significant improvement over the prior art time for rounding conventional toner particles which ranged from two hours to three hours.

The coalescence residence time refers to the time the toner particle slurry spends at a target temperature. In embodiments of the invention, as illustrated in FIG. 1, the coalescence residence time is obtained by flowing the heated toner particle slurry through a residence time coil 120. The residence time coil 120 may include a housing 122 surrounding an internal volume 124. The residence time coil 120 may be a tube having a large diameter, or may be a relatively longer tube having a smaller diameter. There are multiple methods for increasing the local coalescence residence time. The length of the conveying pipe may be increased. Alternatively, or in addition to, the length of the residence time coil 120 may be increased. Both of these techniques increase the local coalescence residence time.

In the residence time coil 120, the coalesced toner slurry is formed. The circularity of the coalesced toner particles can be controlled by adjusting the pH, the flow rate, and the temperature of the coalesced toner slurry. Higher (Desired) circularities are achieved with higher temperatures, lower flow rates, and/or lower pH. Factors for achieving higher circularity can be temperature, flow rates, lower pH and many different combinations are possible. (In certain embodiments of the invention, no mixing elements (i.e., static or rotating) are present in the residence time coil 120. In embodiments, there are no moving parts in the residence time coil 120. In certain embodiments, the flow pattern should have plug-flow characteristics as variations in residence time within the residence time coil will lead to variations in the distribution of mean circularities at the outlet for the coalescence process.

Figure 2:
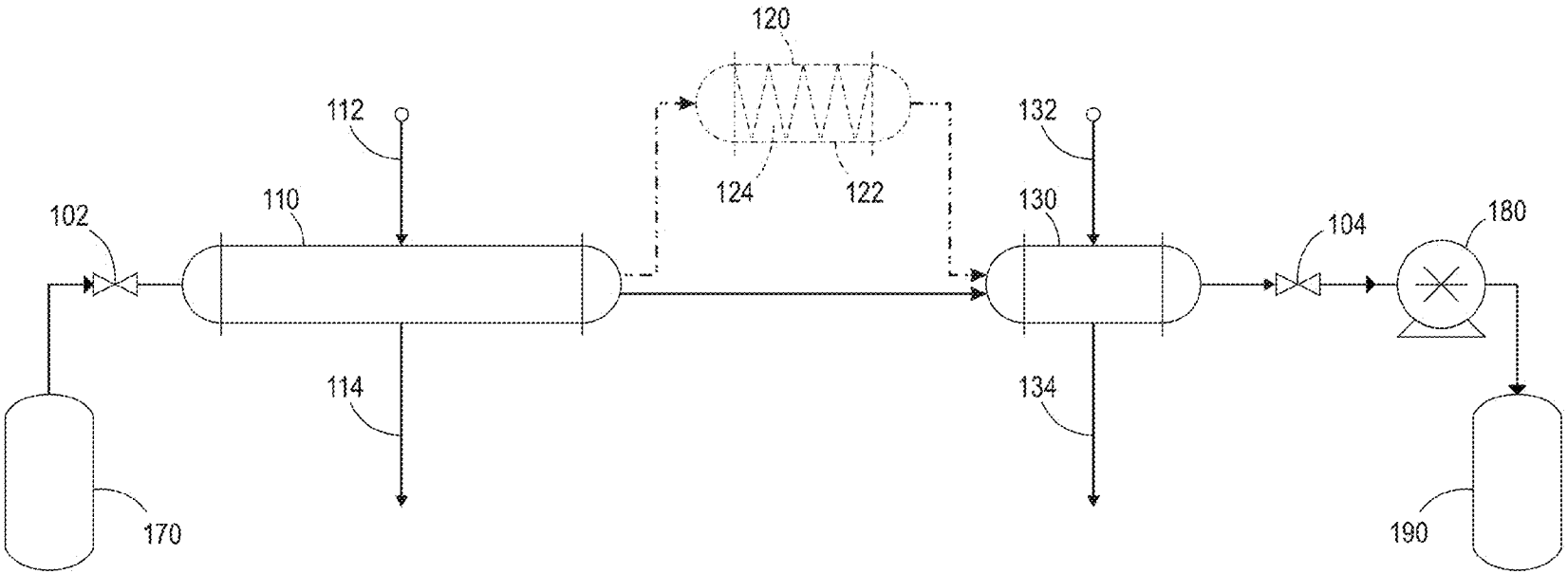
FIG. 2 illustrates a schematic diagram illustrating a second exemplary apparatus suitable for practicing the processes of the present disclosure.

In alternative embodiments of the invention, the first heat exchanger may be oversized and thus coalescence may occur within the first heat exchanger 100. The residence time coil 120 may or may not be needed. The residence time coil 120 may not be needed and this may occur if the first heat exchanger is oversized such that the elevated first temperature is achieved within the first heat exchanger. FIG. 2 illustrates a schematic diagram illustrating a second exemplary apparatus suitable for practicing the processes of the present disclosure. The apparatus 200 includes an oversized heat exchanger 110 for heating the slurry, a second heat exchanger 130 for quenching the slurry and may include a residence time coil 120. The residence time coil 120 is done in a dotted line because it is not a required aspect of this embodiment. This is illustrated in FIG. 2, with the first heat exchanger 110 being depicted as having a greater size than FIG. 1.

After residing in the residence time coil 120 or in the first heat exchanger 110 (in embodiments where there is no residence time coil 120), the coalesced toner slurry is quenched. Quenched means that the temperature is reduced to a second temperature below the glass transition temperature. In embodiments of the invention, the second temperature or quenching temperature is less than 40 C. As is depicted in FIGS. 1 and 2, this quenched coalesced particle slurry then leaves the apparatus through outlet 104. The coalesced particle slurry may then be sent to a receiving tank 190. In embodiments of the invention, the coalesced particle slurry may be transferred into the receiving tank 190 utilizing a pump device 180.

As depicted in FIGS. 1 and 2, the quenching occurs in a second heat exchanger 130. In other embodiments of the invention, other apparatuses may be utilized. In an alternative embodiment of the invention, a residence time coil may be utilized that can reduce the temperature of the coalesced toner particles below the glass transition temperature. In an embodiment of the invention, a cooled receiving tank (e.g., a jacketed CSTR), could also be utilized for quenching the coalesced toner particle slurry. As illustrated in FIG. 1, line 132 represents a cooled secondary fluid used to quench the coalesced particle slurry and line 134 represents the warmed secondary fluid exiting the second heat exchanger 130. The cooled secondary fluid may be ethylene glycol and water. The secondary fluid may have a temperature in the range of 0° C. of 60° C.

The quenched coalesced particle slurry contains coalesced particle which may have an average diameter ranging from about 3 microns to about 25 microns, or in more specific embodiments, a diameter of from about 4 microns to about 15 microns. The quenched coalesced toner particle slurry may have a GSDv and/or a GSDn value of from about 1.15 to 1.30.

The particles in the quenched coalesced toner particle slurry may have a mean circularity of 0.930 to about 0.995, This is a significant improvement over the prior particle circularity of conventional toner particles of 0.92 to 0.93. The quenched coalesced toner particle slurry contains about 10% to 20% by weight of solids and about 80 to 90% by weight of solvent. In embodiments of the invention, the solvent may be water. In addition, the time to obtain these circularities (which represents the rounding of the particles) is significantly decreased. As discussed earlier, the continuous coalescence process outlined in application Ser. No. 14/057,504, "Continuous Toner Coalesence Processes for EA particles", resulted in reduced cycle time and reduced energy consumption for rounding EA particles. In the present invention continuous coalescence process for conventional or MICR toner particles, the conventional or MICR toner particles have the requested circularity figure (0.92 to 0.98) and a lower process time (30 seconds to 20 minutes) as compared to longer process time for the prior art (e.g., 3 to 4 to 5 hours). In addition, the present invention continuous coalescence process minimally disturbs an internal structure of the conventional toner particles.

The slurry can be transferred or drawn through the system by utilizing pressurized transfer. Illustratively, as shown in the system of FIG. 1, the flow rate is controlled by a pump 180 located beyond the outlet 104 of the system apparatus. The pump 180 is located at the exit of the system, rather than between the holding tank 170 and the inlet 102, because placing it on the entrance side of the system reduces handling of the non-coalesced toner slurry. Handling of the non-coalesced toner slurry may degrade the particle size and particle size distribution of the incoming toner particle slurry. The system may operate at a pressure of from about 5 psi to about 50 psi, which is driven by the pump 180.

In embodiments of the invention, where the initial toner particle slurry is preheated in a preheating step prior to coalescence, the degradation of particle size distribution may be mitigated by the preheating. The preheating may allow the particles to partially fuse together and thereby be more resilient to the shearing action of a pump.

In embodiments of the invention, when a temperature of beyond 100° C. is utilized in at least one heat exchanger, the coalescing system may be pressurized to a pressure that is greater than the pressure of water, and this results in suppressing the boiling point of the aqueous component of the toner slurry. In embodiments of the invention, the pressure of one or more of the heat exchangers of the system and/or the entire system may be maintained at a predetermined temperature and predetermined pressure. The predetermined pressure may be from about 1% to 800% greater than the vapor pressure of water (at the predetermined temperature), such as from about 1% to about 220% greater, or from about 5% to about 10% greater, from about 10% to about 30% greater, or from about 15% to 25% greater than the vapor pressure of water (at the predetermined temperature). In embodiments of the invention, for a given temperature, the pressure of one or more of the heat exchangers of the system and/or the entire system may be about 10% greater than vapor pressure of water. It should then be noted that the vapor pressure of water at 100 C is 1 atmosphere, so the pressure of the heat exchanger system would be greater than 1 atmosphere.

In embodiments, the pressure of the system may be maintained at a predetermined pressure by discharging through a back-pressure regulator, a peristaltic pump, a gear pump or a progressive cavity pump. The system may maintain a predetermined pressure by discharging through a back-pressure regulation diaphragm valve or any other means of facilitating back pressure regulation of a particle laden aqueous slurry, which allows for discharge to the atmosphere.

Figure 3:
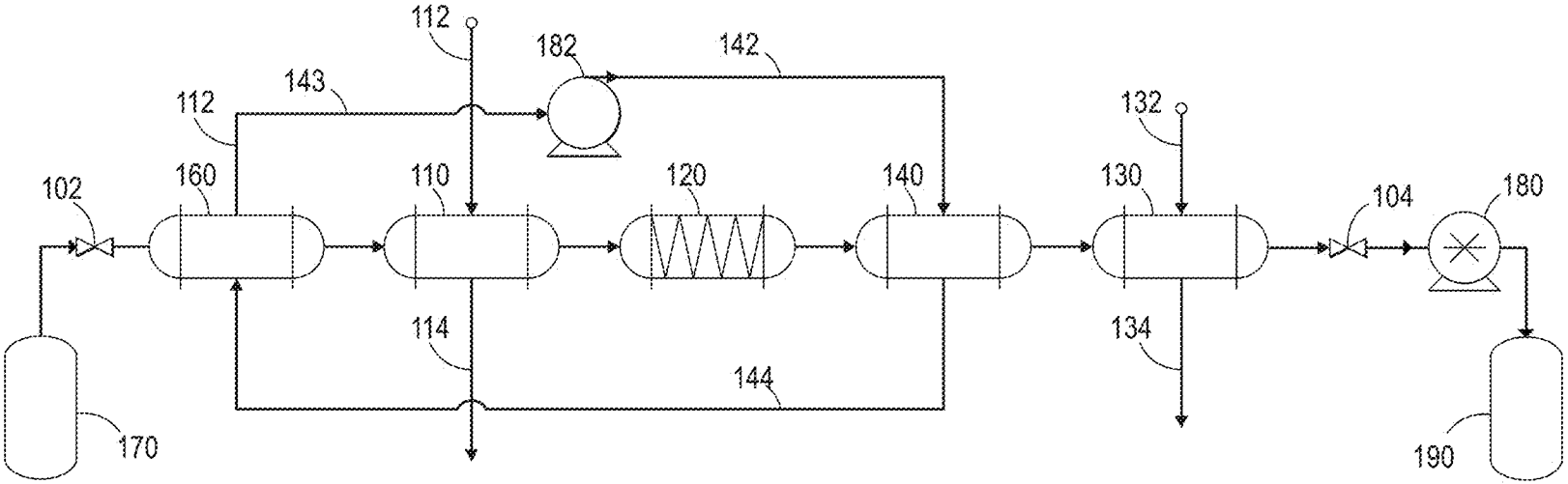
FIG. 3 illustrates a schematic diagram illustrating a third exemplary apparatus suitable for practicing the processes of the present disclosure.

FIG. 3 illustrates a schematic diagram illustrating a third exemplary apparatus suitable for practicing the processes of the present disclosure. The apparatus adds a third and fourth heat exchanger to the apparatus or systems described in FIGS. 1 and 2. The third heat exchanger 140 and a fourth heat exchanger 160 form a loop to recycle heat energy present after coalescence upstream to heat the aggregated slurry. The toner particle slurry initially passes through the fourth heat exchanger 160 but there is no heating or cooling because the heated feedback fluid has not yet been created. The toner particle slurry then enters first heat exchanger 110 and the residence time coil 120 where the toner particle slurry becomes the coalesced toner particle slurry (as is discussed above with regards to FIGS. 1 and 2). The coalesced toner particle slurry passes through a third heat exchanger 140 that cools the coalesced toner particle slurry before the toner particle slurry is quenched in the second heat exchanger 130. A fluid flows through the third heat exchanger and captures the heat energy in the third heat exchanger 140. The fluid travels via line 144 to a fourth heat exchanger 160, where the heat energy is transferred to the incoming aggregated particle slurry. As was discussed before, initially, the fourth heat exchanger 160 will not heat up the incoming aggregated particle slurry because the heated fluid flowing via line 144 has not been created. The heated fluid then exits the fourth heat exchanger 160 via line 143 and travels back to the third heat exchanger 140 via path 142 (utilizing pump 182). Due to heat loss, the energy transferred in this recycling loop 140/144/160/143/142 is insufficient to cause coalescence to begin in the aggregated particle slurry to the first temperature of about 70° C. to about 110° C. Rather, coalescence begins in the first heat exchanger 110. However, the feedback does preheat the initial toner particle slurry. The heat transfer liquid present in the loop may be glycol or another oil which has a high heat absorption capacity.

The continuous coalescence processes of the present disclosure reduce cycle time, reduce downtime due to cleaning, and increase yield. In addition, energy used in heating the slurry may be partially recovered, reducing overall energy consumption and increasing efficiency.

The following examples are for purposes of further illustrating the present disclosure. The examples are merely illustrative and are not intended to limit the disclosure to the materials, conditions or process parameters set forth therein.

Examples

Preparation of an Initial Toner Particle Slurry

Utilizing the process of the invention, toner particles were dispersed in a liquid, run through the continuous coalescent process, and the particles were shape modified into sphers having circularities ranging from 0.970 to 1.000.

In this experiment, cyan iGen parent toner particles (Gen ct410-4323) were obtained via well-known processes. The iGen toner particle was combined with 3700 grams of sodium hydroxide solution having a pH of 9 and also combined with 100 grams of a 10% aqueous Calfax solution. The end result of this combination is four liters of dispersion (which was, by weight, 5% iGen and 0.25% Calfax). The powder wetted easily in one hour using a small laboratory mixer. After mixing, the pH was 3.9. To increase the pH, 32 grams of 0.40 NaOH as added to the solution. The pH initially increased to 6.9, but buffered down over time. Right before the run, the pH was 5.2. The solution was mixed utilizing rotor-stator homogenization and the resulting suspension exhibited no coarse particles (greater than 20 microns). The suspension was held for two days utilizing a fast agitator speed for mixing before being sent through the continuous coalescence toner process of the present invention. This was the initial particle slurry. Right before the run, the toner particle slurry was held at a constant temperature of 49° C.

Before the run, the flow rate was started to initiate flow at 20 milliliters per minute. The first heated liquid, utilized for heating the initial toner slurry to the temperature above the glass temperature, was therminol and was circulated at 102° C. This ensured at outlet temperature of 99° C. coming out of the first heat exchanger. Thus, the heated toner particle slurry had a temperature of 99° C. The heated toner particle slurry was then coalesced in a residence time coil. After coalescing, the coalesced toner particle slurry was quenched. The entire process took three minutes from entry into the first heat exchanger. The outlet material was evaluated using many different tools including a Sysmex 3000 to determine the extent of spheroidization and to note any surface changes.

Figure 4A:
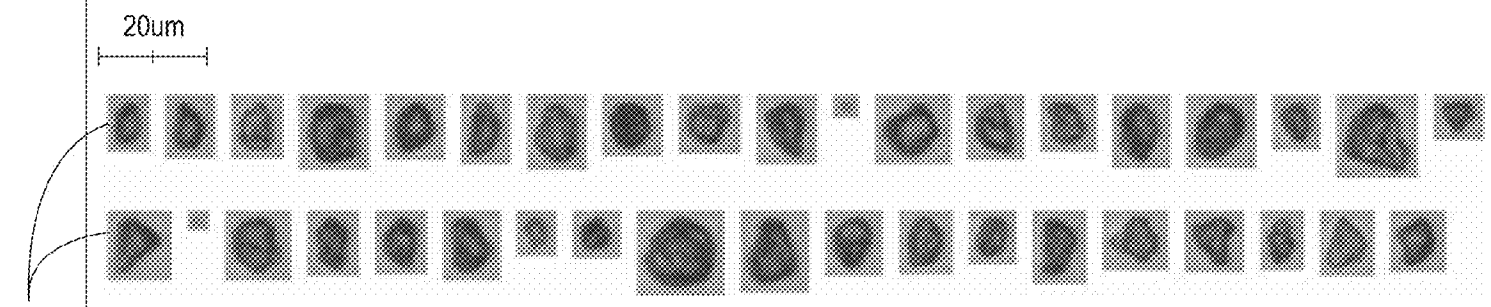
FIG. 4A is a chart and particle photographs showing circularity results for the prior art.
Figure 4B:
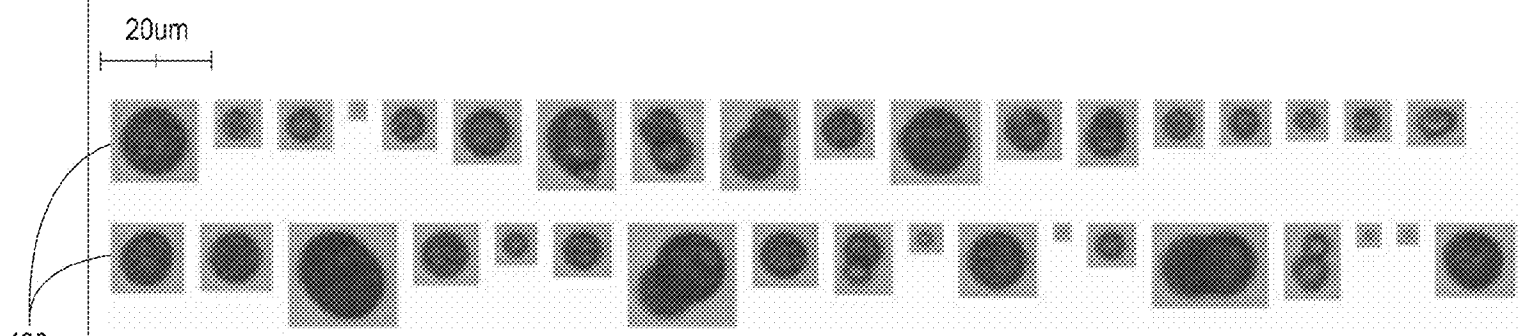
FIGS. 4B and 4C are charts and particle photographs showing circularity results after toner particles have been subjected to the continuous coalescence process of the present invention.
Figure 4C:
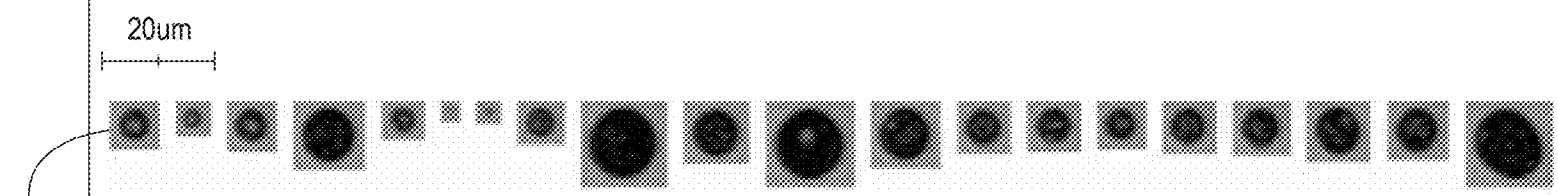

FIG. 4A is a chart and particle photographs showing circularity results before the continuous coalescence of the present inventions. FIG. 4B (at 240 milliliter/minute) and 4C (at 360 milliliter/minute) are charts and particle photographs showing circularity results after toner particles have been subjected to the continuous coalescence process of the present invention. As is illustrated in FIGS. 4B and 4C, the conventional toner photographs show conventional toner particles with a higher circularity (average circularity—0.972) (reference numbers 420 (FIG. 4B) and 430 (FIG. 4C)) than the conventional toner particles before the present invention continuous coalescence process (average circularity—0.942) (reference number 410) (FIG. 4A).

Figure 5A:
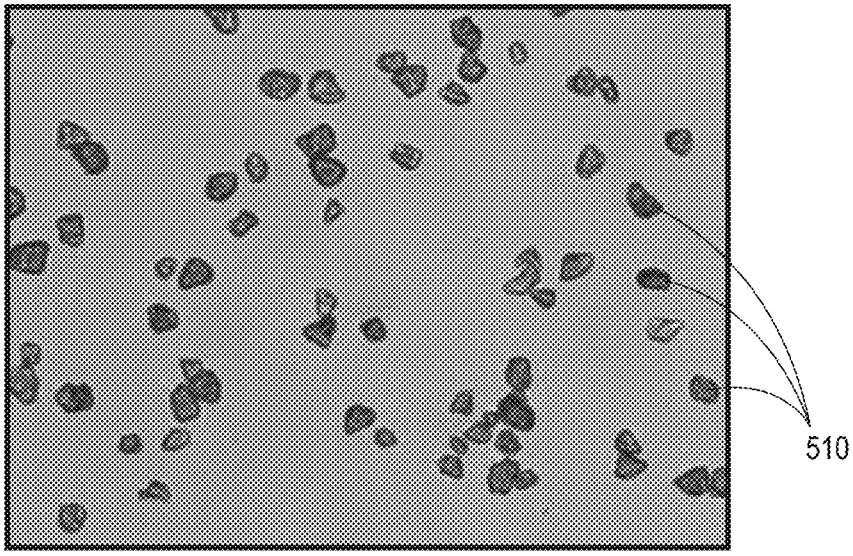
FIGS. 5A and 5B are two light microscope pictures of the un-coalesced particles and the resulting coalesced quenched particles, respectively.
Figure 5B:
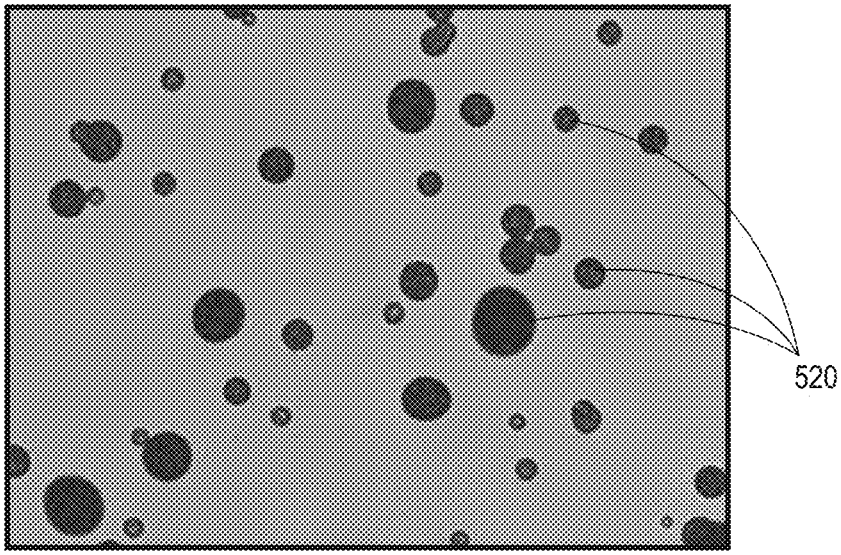
Figure 5C:
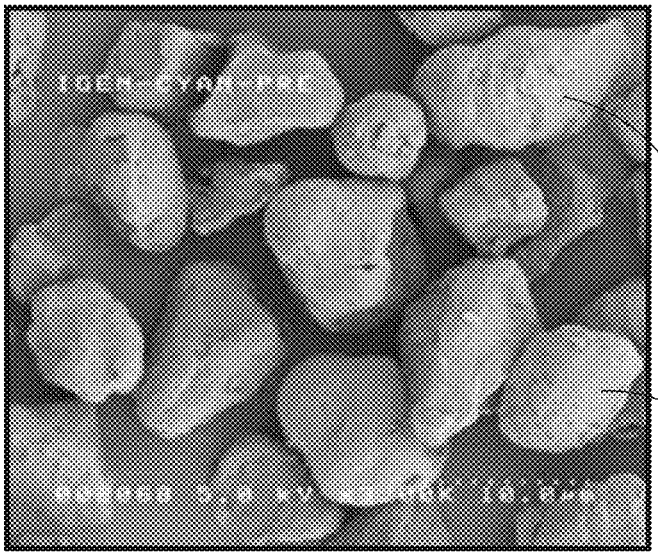
FIGS. 5C and 5D are two SEM pictures of the un-coalesced particles and the resulting coalesced quenched particles, respectively.
Figure 5D:
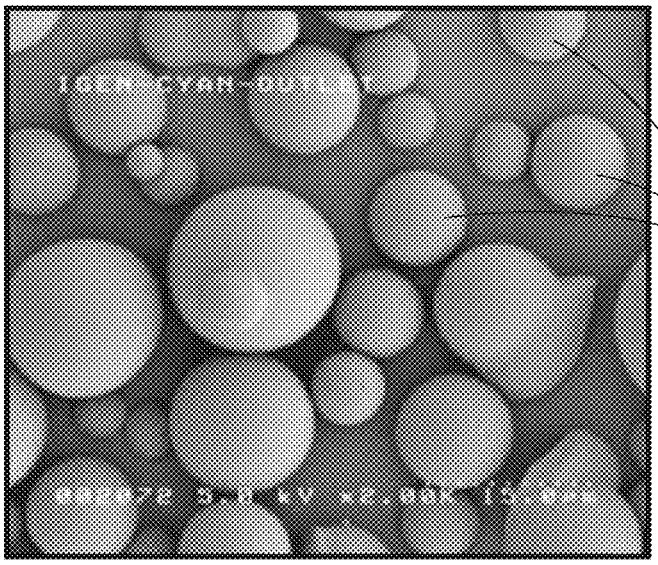

FIG. 5A is a light microscope picture of conventional toner particles before the continuous coalescence process of the current invention and FIG. 5B is a light microscope picture after the continuous coalescence process of the present invention. In FIG. 5A, the conventional toner particles (510) are jagged and uneven and are less circular than the conventional toner particles 520 illustrated in FIG. 5B.

Figure 6A:
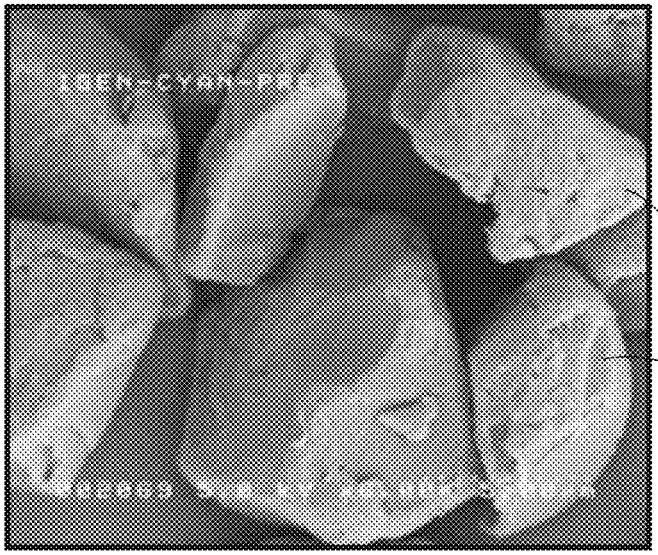
FIGS. 6A-6F are a collection of six scanning electron microscope (SEM) micrographs of the un-coalesced particles (6A,6C,6E) and the resulting coalesced, quenched particles (6B,6D,6F) at various magnifications.
Figure 6B:
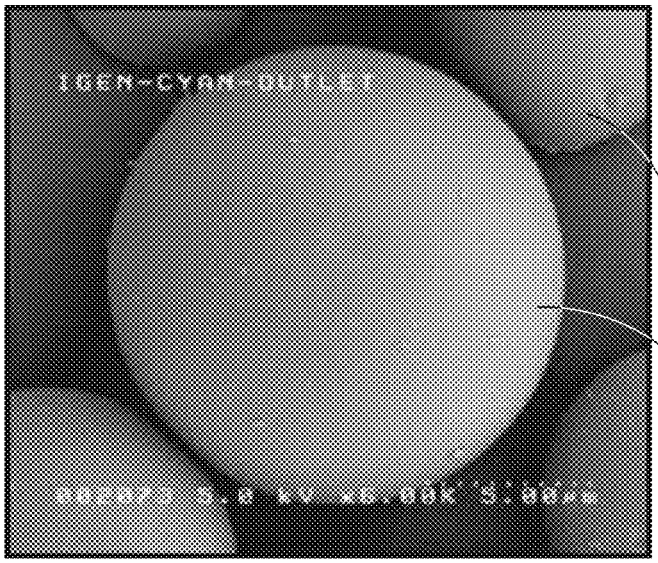
Figure 6C:
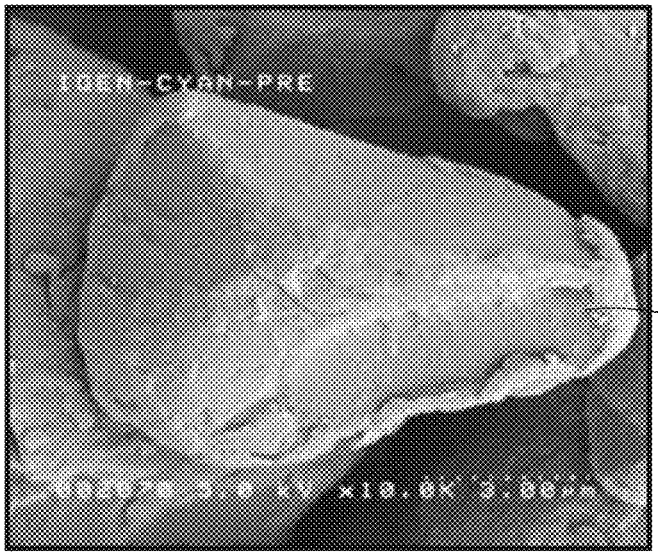
Figure 6D:
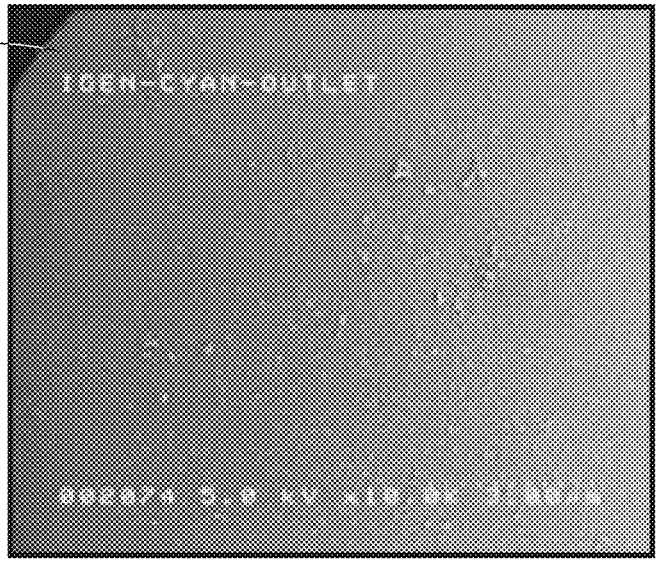
Figure 6E:
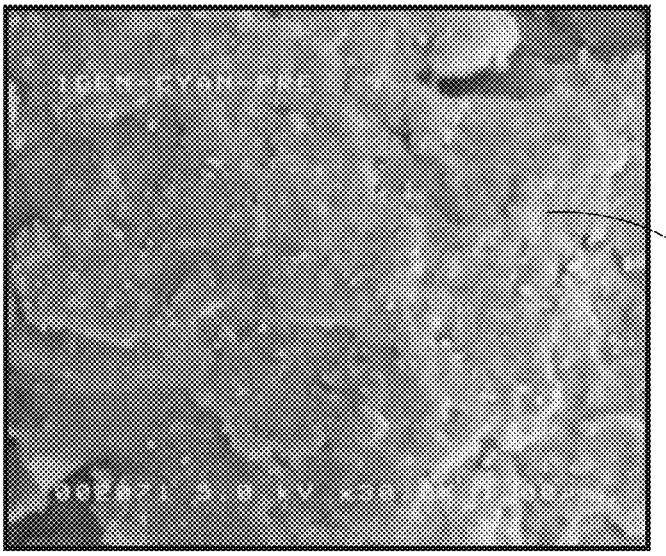
Figure 6F:
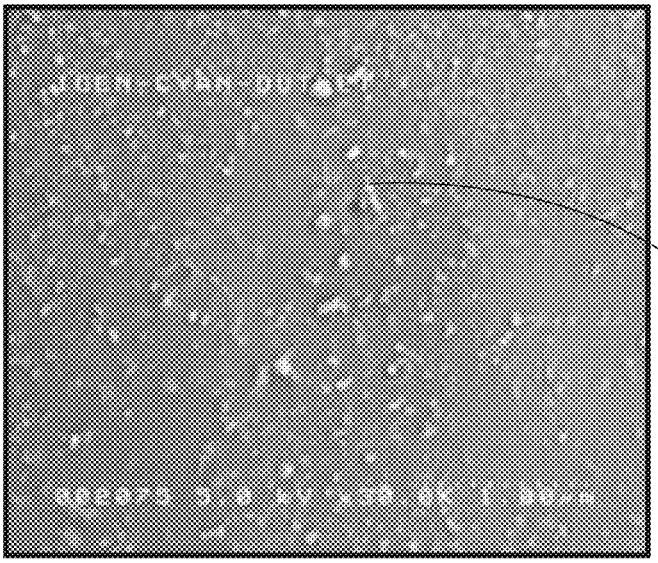

FIGS. 6A, 6C and 6F are scanning electron microscope micrographs of the conventional toner particles (610, 630, and 650 respectively) before the application of the continuous coalescence process of the current invention at a magnification of 6000, 10000 and 30000. FIGS. 6B, 6D and 6E are scanning electron microscope micrographs of the conventional toner particles (620, 640 and 660, respectively) after the continuous coalescence process of the present invention at the same magnifications. The conventional toner particles in FIGS. 6B, 6D and 6F are more circular than the particles in FIGS. 6A, 6C and 6E.

Figure 7A:
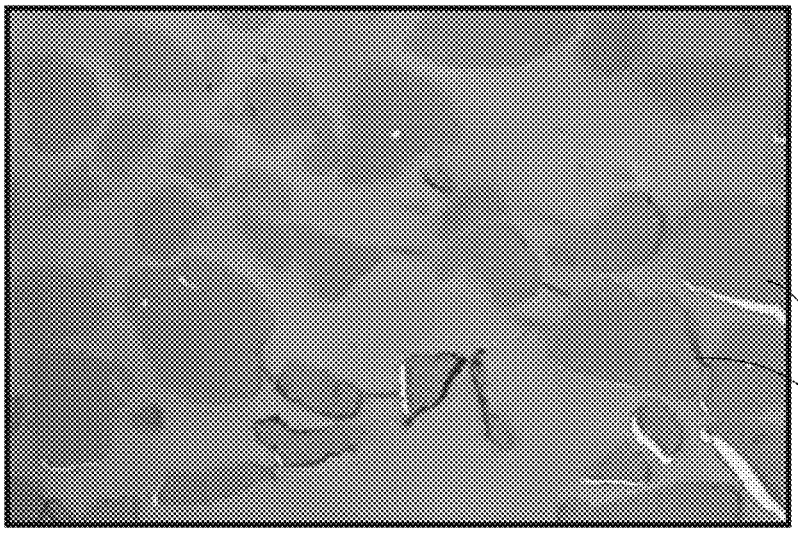
FIGS. 7A-7F are a collection of six transmission electron microscope micrographs of the initial toner particles at the inlet (7A, 7C, 7E) and the resulting coalesced quenched toner particles at the outlet (7B, 7D, 7F) at various magnifications according to an embodiment of the present invention.
Figure 7B:
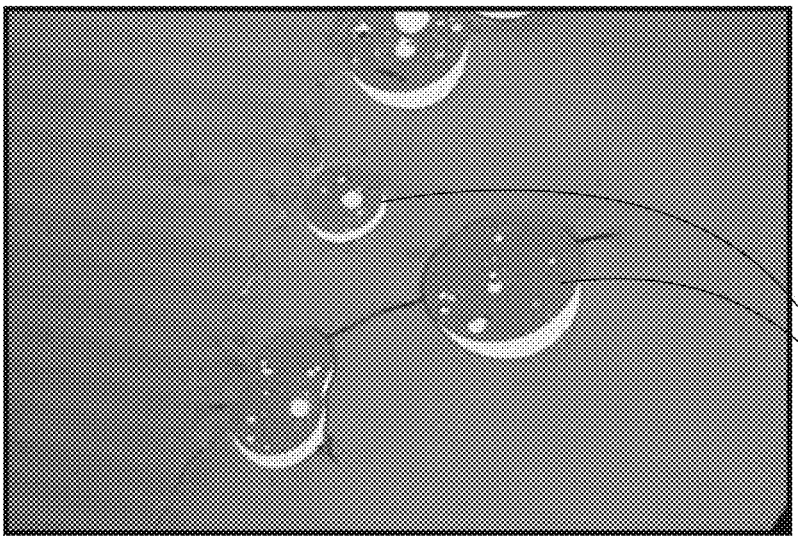
Figure 7C:
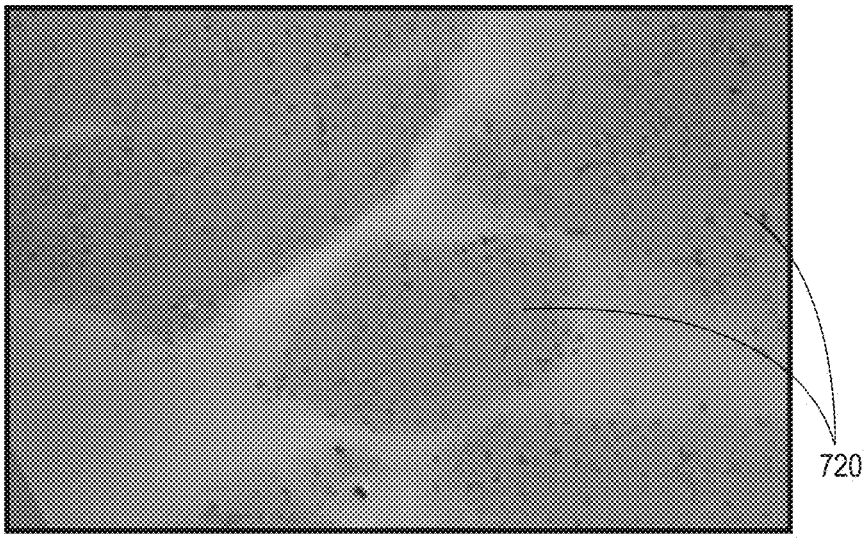
Figure 7D:
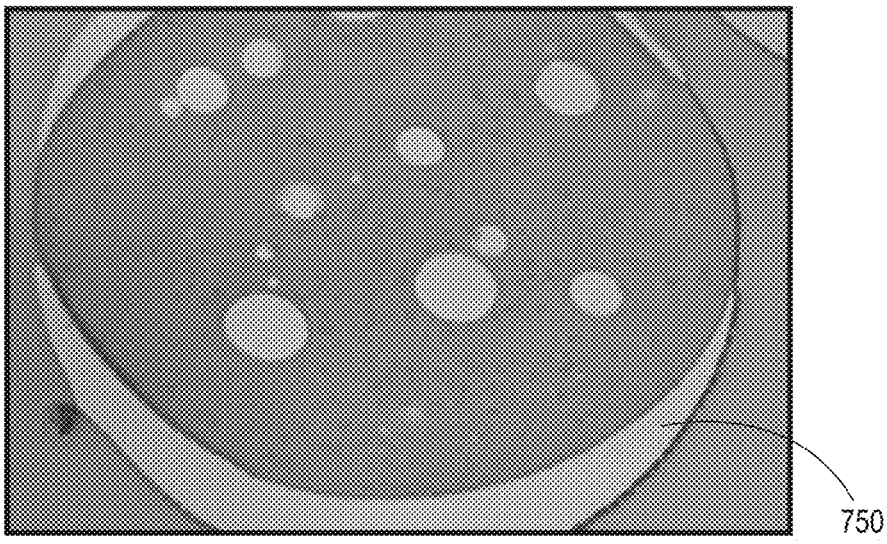
Figure 7E:
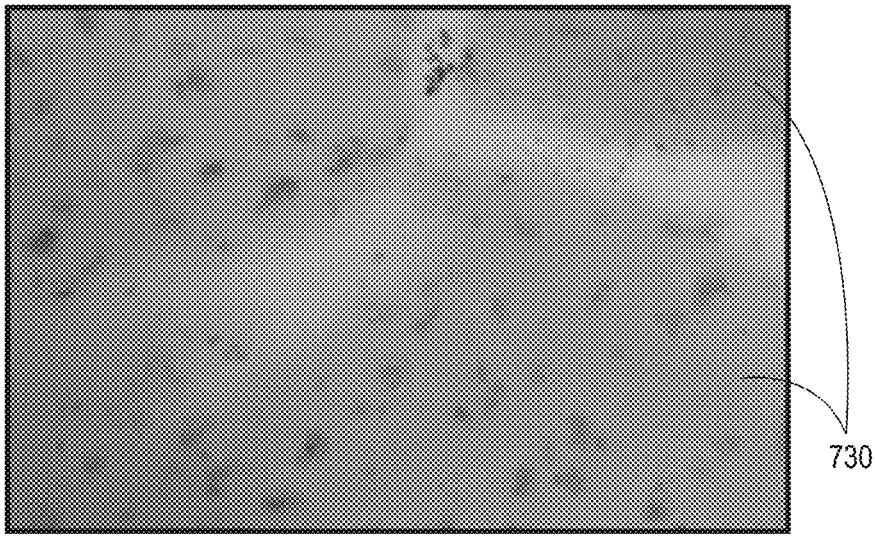
Figure 7F:
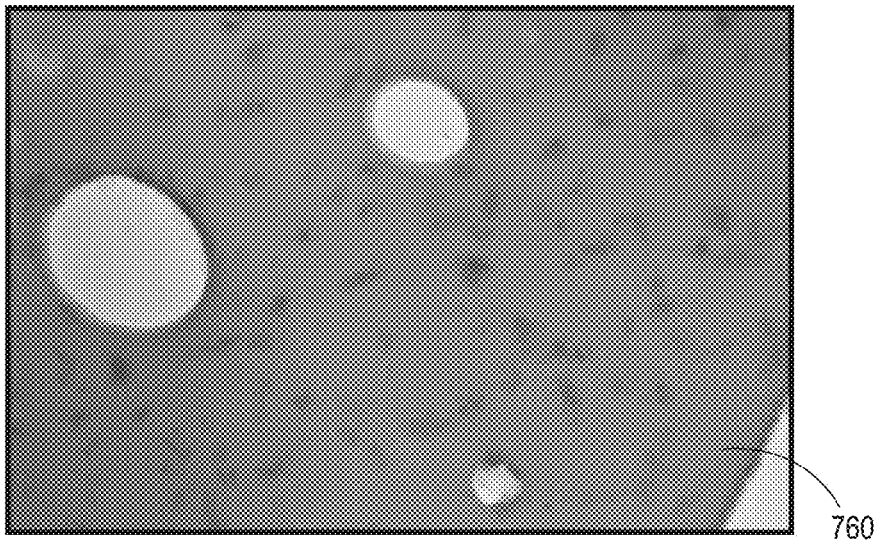

FIGS. 7A, 7C and 7E are three transmission scanning electron microscope micrographs of the initial conventional toner particles 710, 720 and 730 at the inlet of the apparatus of the present invention at magnifications of 700,000; 3.5 million and 12 million. FIGS. 7B, 7D and 7F are three transmission scanning electron micrographs of the conventional toner particles 740, 750, and 760 at the output of the apparatus of the present invention after the continuous coalescence process of the current invention at the same magnifications. The transmission scanning electron micrographs illustrate the circularity of the conventional toner particles after the continuous coalescence process of the present invention. These micrographs (specifically FIGS. 7B, 7D and 7F) also illustrate that the internal structure of the conventional toner particles is not damaged or minimally damaged as a result of the continuous coalescence process of the current invention.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A continuous process for rounding conventional toner particles comprising;

forming a conventional toner particle slurry by mixing a dispersant and/or a liquid with dry toner particles;

heating, in a first heat exchanger, the conventional toner particle slurry to a first temperature beyond its glass transition temperature to form a coalesced toner particle slurry;

quenching the coalesced toner particle slurry to a second temperature below the glass transition temperature after a residence time; and recovering the quenched particle slurry at an outlet, wherein the circularity of the conventional toner particles in the quenched toner particle slurry is from approximately 0.940 to 0.999 and the time frame for the heating, quenching and recovering steps is less than 20 minutes.

2. The continuous process of claim 1, wherein an internal structure of the conventional toner particles is minimally disturbed by the continuous process for rounding conventional toner particles.

3. The process of claim 1, wherein the toner particle slurry has a starting temperature of from ambient to about 65° C. prior to entering the first heat exchanger.

4. The process of claim 1, wherein the toner particle slurry is preheated and has a starting temperature from about 5 degrees greater than Tg to about 30 degrees greater than Tg prior to entering the first heat exchanger.

5. The process of claim 1, wherein the first temperature is from about 70 to about 110° C.

6. The process of claim 1, wherein the quenching occurs in a coil, a second heat exchanger, or in a cooled receiving tank.

7. The process of claim 1, wherein the pressure of the first heat exchanger is from about 1% to about 20% greater than the vapor pressure of water at the first temperature.

8. The process of claim 1, wherein the heated toner particle slurry exits the first heat exchanger and coalesces in a residence time reactor to form the coalesced particle slurry, before being quenched.

9. The process of claim 1, wherein the toner particle slurry is drawn into the first heat exchanger by a pump at the outlet.

10. The process of claim 1, wherein the toner particle slurry has a pH of about 6 to about 10 prior to entering the first heat exchanger.

11. The process of claim 1, further comprising lowering the pH of the toner particle slurry prior to flowing the toner particle slurry through the residence time coil.

12. The process of claim 11, wherein the pH of the toner particle slurry is lowered/raised to a value from about 5 to 8 prior to entering the first heat exchanger.

13. The process of claim 11, wherein the pH of the toner particle slurry is lowed by addition of a buffer solution or an acidic solution.

14. The process of claim 11, wherein the toner particle is a magnetic ink character recognition toner particle.

15. The process of claim 1, wherein the residence time is from about 10 seconds to about 15 minutes.

16. The process of claim 1, wherein heat energy captured prior to quenching the coalesced toner slurry in the second heat exchanger is transferred to the toner particle slurry prior to coalescence in later flows of the toner particle slurry.

17. An apparatus for continuous coalescence of toner particles, comprising:

an inlet passage;

a first heat exchanger coupled to the inlet passage;

a residence time coil coupled to the first heat exchanger;

a cooling device coupled to the residence time coil; and an outlet passage coupled to the cooling device, wherein a toner particle slurry is transferred from the inlet passage to the first heat exchanger and to the residence time coil to become a coalesced toner particle slurry and the coalesced toner particle slurry is transferred to the cooling device to become the quenched toner particle slurry and then transferred to the outlet passage, wherein the circularity of the conventional toner particles in the quenched toner particle slurry is from approximately 0.940 to 0.999 and the time frame for the heating, quenching and recovering steps is less than 20 minutes.

18. The apparatus of claim 17, wherein the cooling device is a second heat exchanger or a cooled receiving tank.

19. The apparatus of claim 17, further comprising a recycle loop wherein heat energy is captured between the residence time coil and the cooling device and the heat energy is transferred to fluid upstream of the residence time coil.

20. The apparatus of claim 19, the recycle loop comprising a third heat exchanger located between the residence time coil and the cooling device, and a fourth heat exchanger located upstream of the first heat exchanger, wherein a heat transfer fluid flows in a loop between the third heat exchanger and the fourth heat exchanger.

* * * * *